US005873714A

United States Patent [19]

Mosci

[11] Patent Number: 5,873,714

[45] Date of Patent: Feb. 23, 1999

[54] ROTARY KILN HAVING A LINING WITH A WAVE-SHAPED INNER FACE

[75] Inventor: Ricardo A. Mosci, Butler, Pa.

[73] Assignee: Reframerica, Inc., Butler, Pa.

[21] Appl. No.: 805,886

[22] Filed: Mar. 3, 1997

[51] Int. Cl.[6] ..... F27B 7/28

[52] U.S. Cl. ..... 432/119; 432/108; 432/118

[58] Field of Search ..... 432/103, 105, 432/108, 110, 118, 119

[56] References Cited

U.S. PATENT DOCUMENTS

| | | | |
|---|---|---|---|
| 1,641,337 | 9/1927 | Komarek | 432/108 |
| 1,916,170 | 6/1933 | Hart . | |
| 2,190,271 | 2/1940 | Powell | 432/108 |
| 2,633,347 | 3/1953 | Heyman | 432/119 |
| 3,593,970 | 7/1971 | Seebald . | |
| 3,882,801 | 5/1975 | Bolle | 432/119 |
| 4,026,821 | 5/1977 | Schoofs et al. | 432/118 |
| 4,029,464 | 6/1977 | Kamstrup-Larsen | 432/119 |
| 4,136,965 | 1/1979 | Sunnergren et al. | 432/118 |
| 4,200,469 | 4/1980 | Touborg . | |
| 4,344,596 | 8/1982 | Hjaeresen . | |
| 4,978,294 | 12/1990 | Uemura et al. | 432/119 |
| 5,097,773 | 3/1992 | Freeman . | |
| 5,299,933 | 4/1994 | Mosci . | |
| 5,460,518 | 10/1995 | Mosci . | |

FOREIGN PATENT DOCUMENTS 1814484 6/1970 Germany .

*Primary Examiner*—Teresa J. Walberg
*Assistant Examiner*—Jiping Lu
*Attorney, Agent, or Firm*—George C. Atwell

[57] ABSTRACT

A kiln for pyro-processing a variety of materials, such as cement, lime, lime sludge, clay, shale, magnesite, dolomite, and other minerals, includes a continuously-rotated, cylindrical, elongated shell having a feed end for receiving the material, a processing zone through which high temperature gases circulate and where the material is processed, and a discharge end where the material leaves the kiln. The shell includes an inner cylindrical surface and defines a longitudinal axis extending from the feed end to the discharge end. In addition, a portion of the inner cylindrical surface includes a lining secured contiguous to the inner cylindrical surface. The lining has an inner face in the shape of a continuous sinusoidal wave with a predetermined amplitude and wavelength. The lining is disposed annularly about the open processing zone and the inner face of the lining includes a plurality of peaks and troughs of equal height and depth for improving the efficiency of the heat transfer between the high temperature gases and the material moving through the kiln, increasing the mixing, revolving, and agitation of the material, and increasing the residence time of the material within the kiln.

13 Claims, 3 Drawing Sheets

ROTARY KILN HAVING A LINING WITH A WAVE-SHAPED INNER FACE

BACKGROUND OF THE INVENTION

The present invention relates generally to rotary kilns and, more particularly, to a rotary kiln having an inner lining with a a sinusoidal wave-shaped face for pyro-processing material, such as cement, lime, lime sludge, and other minerals.

Conventional rotary kilns used for pyro-processing a wide variety of materials, such as cement, lime, lime sludge, rocks, and minerals, are commonly lined with bricks to protect the inner annular surface of the shell of the kiln. The bricks are of a refractory composition which is sufficiently resistant to the intense heat produced in the kiln to protect the shell from degradation. For example, the processing zone within the shell of a cement kiln attains a temperature of 2700° F. and, in order to withstand such intense heat, the lining is preferably manufactured from an abrasive and heat resistant castable ceramic or brick material.

For kilns using a refractory lining of bricks, the tapered or specially-shaped bricks are secured to the inner annular surface of the shell so that the bricks extend along the inner circumference of the shell. The bricks form an annular ring about the processing zone and, in addition to protecting the steel shell, they reduce the heat loss through the steel shell to the external environment.

Moreover, the lining may be formed from a granular refractory material which is mixed with water to form a concrete-like material that is cast onto the inner annular surface of the shell. The particular configuration of the lining may be achieved by the use of forms and appropriate spacers which define the volume which is to be filled or cast with the refractory material. The lining may be formed by precasting an appropriate configuration which has a base shaped to conform to the inner annular surface of the shell. The base may be made of steel to facilitate attachment to the metal shell. After the refractory material is precast into the shape, it is inserted into the shell and secured to the inner annular surface by being bolted or welded thereto.

Conventional rotary kilns with present refractory lining designs are heat inefficient, resulting in a high fuel cost. For example, although the theoretical heat of formation of a Type I cement clinker is 420 kcal/kg, typical dry and wet process kilns consume far greater energy, approximately 1100 kcal/kg (38% heat efficiency) and 1300 kcal/kg (32% heat efficiency), respectively. Similarly, for lime kilns, typical heat efficiencies are in the range of about 40%. Such low heat efficiencies result from surplus heat being dissipated in the stack gases, lost by radiative heat transfer through the shell of the kiln and also being dissipated with the product itself.

SUMMARY OF THE INVENTION

The present invention comprehends a rotary kiln for pyro-processing a wide variety of materials and includes an elongated, cylindrical shell through which the material traverses for processing. The kiln shell is rotated by conventional mechanical structure and includes a feed end and an opposite discharge end, and defines a longitudinal axis extending from the feed end to the discharge end. Furthermore, the shell includes an open processing zone extending from the feed end to the discharge end through which the material travels and the high temperature gases circulate. The shell includes an inner cylindrical surface circumjacent the open processing zone. A lining is disposed contiguous to the inner cylindrical surface and annular to the longitudinal axis. The lining has an inner face in the shape of a continuous sinusoidal wave. The wavy or sinusoidal wave-shaped inner face of the lining has a predetermined amplitude and wavelength and the lining is annularly secured to at least a portion of the inner cylindrical surface of the shell.

The wave-shaped inner face of the lining may be formed by installing pre-shaped bricks contiguous to the inner cylindrical surface or by casting an appropriate heat and abrasion resistant refractory or ceramic material onto the inner cylindrical surface of the shell so that, when viewed along the longitudinal axis of the shell, the inner face of the lining has a wavy, sinusoidal cross section.

It is an objective of the present invention to provide a lining for a kiln in which the inner face of the lining is wave-shaped for enhancing the heat transfer between the kiln gases and the material traversing the kiln.

It is a further objective of the present invention to provide a lining for a kiln in which the surface area of the inner face of the lining in contact with the material under processing is increased to enhance heat transfer.

It is another objective of the invention to provide a lining for a kiln in which the inner face of the lining is wave-shaped so that fresh surfaces of the material are continuously exposed to the hot kiln gases.

It is yet another objective of the present invention to provide a lining for a kiln in which the inner face of the lining is wave-shaped for achieving a thorough, homogeneous mixing of the material.

It is a further objective of the present invention to provide a lining for a kiln in which the inner face of the lining is wave-shaped for increasing the agitation and cooling of the material before discharging the material into the mechanical clinker cooler.

It is a still further objective of the present invention to provide a lining for a kiln in which the inner face of the lining is wave-shaped for increasing the metal dross recovery in slag or dross metal by tumbling the metal dross or slag before discharge from the kiln.

A further objective of the present invention is to provide a lining for a kiln in which the inner face of the lining is wave-shaped for increasing the residence time of the material within the kiln, so that the processing time of the material is extended.

Yet a further objective of the present invention is to provide a lining for a kiln in which the inner face of the lining is wave-shaped for extending the residence time of the material within the kiln so that the material is in contact with heat for a longer time period.

Still another objective of the present invention is to provide a lining for a kiln in which the inner face of the lining does not deteriorate the material during the thorough, homogeneous mixing of the material as the material is being processed.

A still further objective of the present invention is to provide a lining for a kiln in which the inner face of the lining prevents the balling up of material as the material is processed in the kiln.

It is moreover a further objective of the present invention to provide a lining for a kiln in which the inner face of the lining can be installed in kilns having diameters ranging from the industry minimum to the industry maximum.

The above features, together with other objects and advantages which will become subsequently apparent, reside in the details of construction and operation as more fully hereinafter described and claimed, reference being had to the accompanying drawings, forming a part hereof, wherein like numerals refer to like parts throughout.

DETAILED DESCRIPTION OF THE PREFERRED EMBODIMENT

Illustrated in FIGS. 1–9 is a rotary kiln 10 for pyro-processing a wide variety of materials 12 used, for example, in the agricultural, chemical, petrochemical, metallurgical, construction, and building industries. The material 12 may also be referred to as the burden, throughput, or feed. Rotary kilns are essentially large, elongated ovens that may be up to 400 to 450 feet long and have diameters ranging anywhere from nine feet to 22 feet, eight inches. Rotary cement kilns are typically 15 feet in diameter and 230 feet long. Temperatures can reach several thousand degrees within the kiln from the introduction of hot gases; for example, in the processing zone of cement kilns, temperatures may reach 2700° F. At this temperature, the molecules comprising the raw materials being processed break apart and recombine to form new compounds which, in the cement industry, are called "clinker". Typically, in all rotary kilns, the temperatures only reach several thousand degrees Fahrenheit in a certain portion of the kiln which is generally described as the open processing zone; and the open processing zone is generally adjacent the end of the kiln from which the material is discharged.

Figure 8:
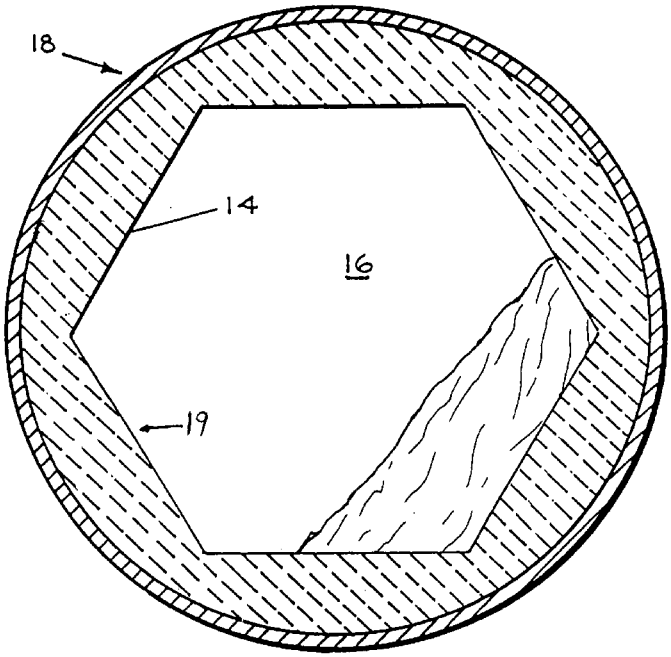
FIG. 8 PRIOR ART
FIG. 8 is a cross sectional view of a prior art kiln having a polygonal-shaped inner face.

In order to protect the inner annular wall of the kiln shell from deterioration and destruction by such high temperatures, a lining 14, as shown in FIG. 8 and denoted as prior art, is annularly disposed around at least a portion of the inner wall adjacent an open processing zone 16 of a kiln 18. The lining 14 may be made from various types of refractory materials; for a cement kiln, the lining material is, preferably, an abrasive, heat-resistant, castable ceramic or brick material. In typical rotary kilns, the refractory lining is disposed only on a portion of the inner annular wall of the kiln. The lining 14 of the prior art has an inner face 19 or processing surface that is polygonal-shaped in cross section. The parameters of a kiln which cannot vary greatly include the slope of the kiln, the kiln velocity, and the residence time of the material within the kiln.

Shown in FIGS. 1–7 and 9 is the rotary kiln 10 along with structural elements for rotating the kiln 10 and also for providing the kiln 10 with the material 12 to be processed. The kiln 10 includes an elongated, cylindrical, selectively-rotatable shell 20 which has a feed end 22 and an opposite discharge end 24 and in cross section defines an open processing zone 25. The kiln 10 is positioned so that the discharge end 24 is at a level sufficiently lower than that of the feed end 22 in order to cause the material 12 being to processed to move toward the discharge end 24. If desired, a flexible seal 26 may be attached to the feed end 22 in order to cover at least a portion thereof. A funnel 28 manufactured of suitable material may be connected to the seal 26 by an extension tube 30. A small aperture (not shown) in the center of the seal 26 allows the tip of the tube 30 to extend slightly into the feed end 22 for feeding the material 12 into the kiln 10. After the material 12 is processed, it passes through the kiln 10 to the discharge end 24. For cement kilns, the discharge end 24 is in flow communication with a clinker cooler so that the material 12 leaves the discharge end 24 whereupon it is cooled in the clinker cooler and then further ground and processed into a fine powder (cement) for transportation to ready-mix concrete makers.

Figure 1:
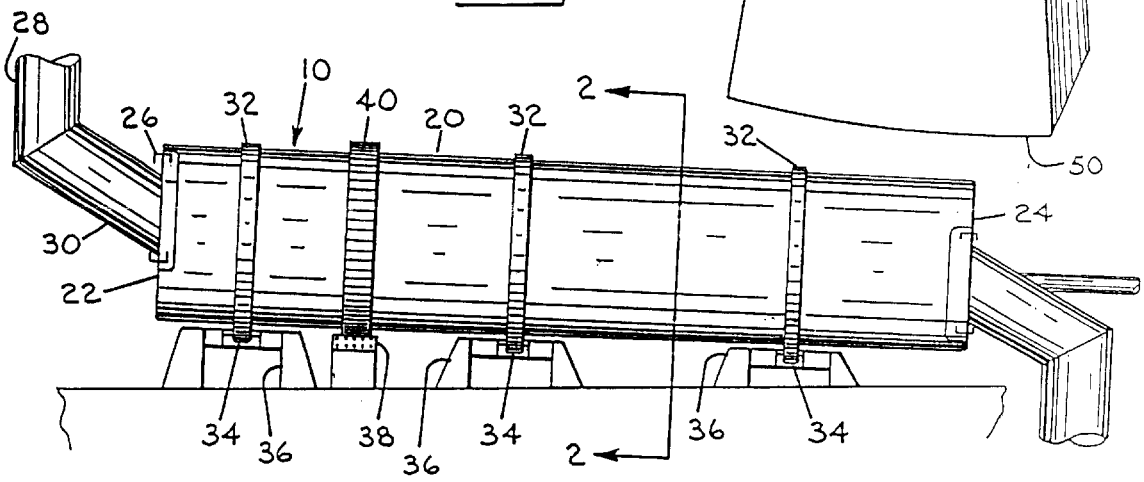
FIG. 1 is a side elevational view of a rotary kiln incorporating a lining having a wave-shaped inner face.

As shown in FIG. 1, the shell 20 is supported by riding rings or tires 32 that engage steel rollers 34 which are supported on steel frames 36. In operation, the kiln 10 is driven by a motor reductor set (not shown) connected to a pinion 38 and a main gear 40. The mechanical structure for rotary kilns and also for firing the kilns for pyro-processing is well known and conventional in the art and, accordingly, need not be hereinafter described. However, for a detailed description of the operation methods of firing of rotary kilns, see, for example, U.S. Pat. Nos. 4,200,469 and 4,344,596.

As illustrated in FIGS. 2, 3, 5–7, and 9, the shell 20 includes an outer annular surface 42 and an opposite inner cylindrical surface 44, and both surfaces 42 and 44 extend from the feed end 22 to the discharge end 24. In addition, the elongated shell 20 defines an imaginary longitudinal axis which also extends from the feed end 22 to the discharge end 24 and about which the kiln 10 circumjacently rotates. A lining is disposed within the shell 20 and is secured contiguous to the surface 44 for protecting the shell 20. The lining has an inner face or processing surface upon which the material 12 flows. As shown in FIGS. 2, 3, 5–7, and 9, the inner face of the lining has a curvilinear or wavy shape or form. More specifically, the inner face has the form of a trigonometric sine or sinusoidal wave which extends or is propagated annularly about the surface 44. A sine wave (also known as a sinusoidal wave) is a wave whose amplitude varies as the sine of a linear function of time. The sinusoidal wave-shaped inner face has the properties of a periodic sine wave, including wavelength, amplitude, and frequency. Thus, the peaks and troughs of the wave-shaped inner face are of equal height and depth for creating a periodic sine wave; however, the amplitude and wavelength defined by the wave-shaped inner face can vary from kiln to kiln. Other types of periodic waves, such as cosine waves, may also be used in place of the sinusoidal wave. The inner face of the lining, as shown in FIGS. 2, 3, 5–7, and 9, is essentially a physical representation of the form or shape of a sine wave.

As shown in FIGS. 2–4 and 9, in the preferred embodiment, a lining 46 having a wave-shaped or wavy inner face 47 is actually formed by a specially configured refractory brick 48, a plurality of which are annularly arranged around the surface 44 in such a way as to form the desired sinusoidal wave-shaped inner face 47. Therefore, a series of these bricks 48 are secured to and laid upon the surface 44 to form the inner face 47. Each brick 48 includes a base portion 50 which would be disposed contiguous to the surface 44, a major body portion 52, an inwardly-projecting portion or protrusion 54 which projects toward the longitudinal axis and comes in contact with the material 12 traversing the kiln 10, and a rear surface 56 which, when disposed to form the lining 46, abuts the rear surface 56 of the next brick 48 arranged in the series. In addition, each brick 48 has an S-shaped slope 58 which runs from the protrusion 54 to the base 50 and which also comes in contact with the material 12 traversing the kiln 10. The tip of each protrusion 54 corresponds to one peak in the continuous wave-shaped inner face 47 of the lining 46 while the S-shaped slope 58 of two adjacent bricks 48 forms one trough of the wave-shaped inner face 47. Furthermore, the lowest point of the trough is defined where the S-shaped slope 58 of one brick 48 abuts the S-shaped slope 58 of an adjacent brick 48.

In order to secure the bricks 48 to the surface 44 so as to form the lining 46 and the wave-shaped inner face 47, each brick 48 is installed and secured to the surface 44 by conventional methods such as glueing, pogo-sticks, etc., with or without the use of mortar. The base 50 of each brick 48 is secured directly to the surface 44 while the protrusion 54 is directed radially inward toward the longitudinal axis of the kiln 10 and also toward the open processing zone 25. The bricks 48 are wedged against each other along the circumference of the surface 44 and extend inwardly in order to define the particular sinusoidal wave shape of the inner face 47. It should be understood that the entire kiln 10 does not have to include the lining 46 with the wave-shaped inner face 47; the lining 46 should be installed at least in the calcining, preheating, transition and discharge zones of the kiln 10.

Typically, the bricking of the surface 44 commences at the lowest point 60 of the shell 20 and then extends upward in both a clockwise and a counterclockwise direction to the topmost point 62 of the shell 20. It is also typical that the last brick 48, the keystone brick, to be secured to the surface 44 at point 62 may require special cutting to fill that last remaining gap. The particular dimensions of the brick 48, or the cast lining, which defines the wavelength and amplitude of the inner face 47, can be varied in accordance with the diameter of that particular kiln, the thickness of the lining of the kiln, and the granularity of the material being processed. For the present invention, the sine wave formed by the inner face 47 should have a wavelength of between one and three feet and an amplitude of between two and four inches in order to assure a high heat efficiency between the shell 20, the lining 46, and the bricks 48, and a thorough mixing action of the material 12 irrespective of the diameter of the particular kiln.

Figure 2:
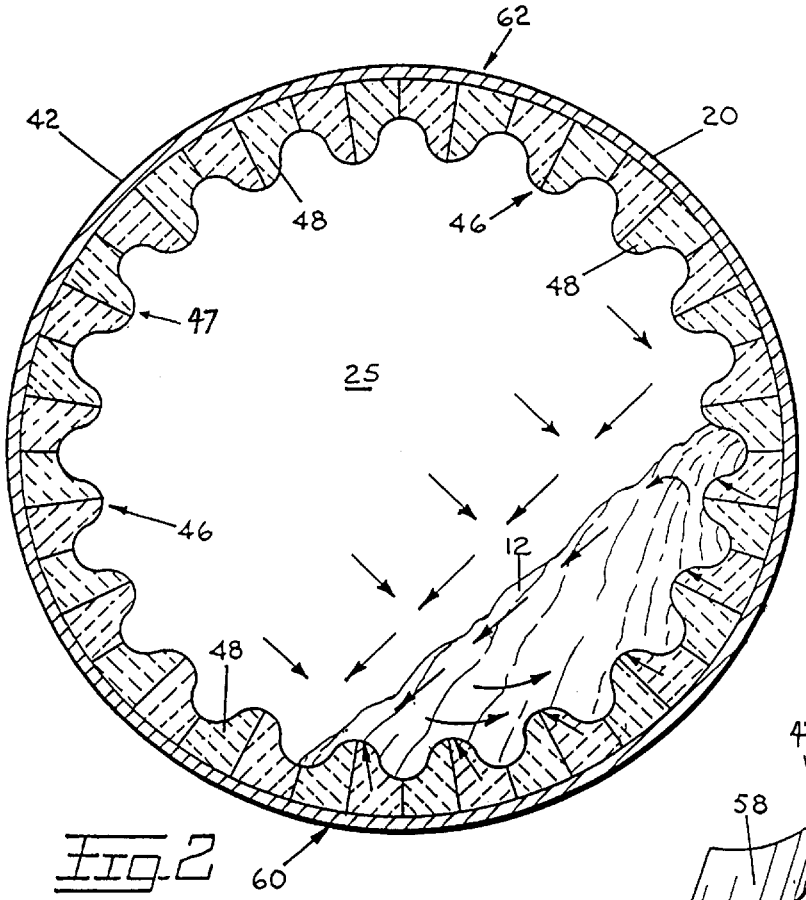
FIG. 2 is a cross sectional view taken along lines 2—2 of FIG. 1 illustrating the wave-shaped inner face of the lining.
Figure 4:
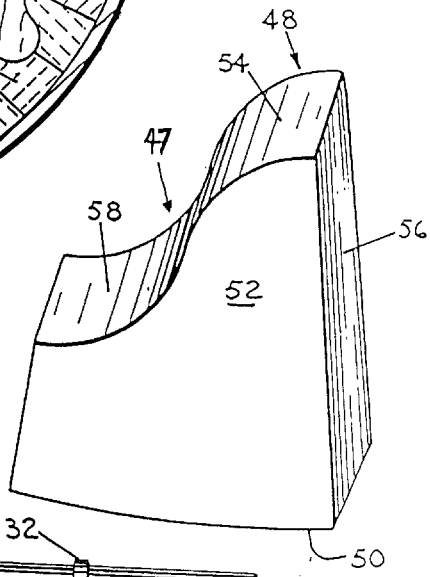
FIG. 4 is a perspective view of a refractory brick first shown in FIGS. 2.
Figure 9:
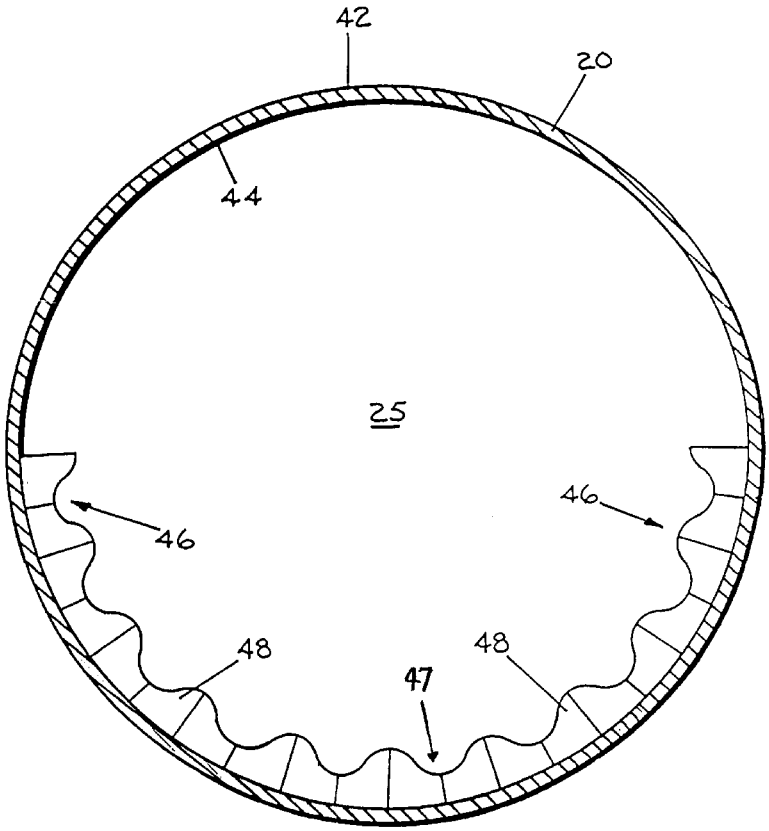
FIG. 9 is a cross sectional view of the kiln first shown in FIG. 2, with refractory bricks secured to the lower half of the kiln shell.

As shown in FIG. 2 and 9, for attaining the maximum amount of thorough, homogeneous mixing and heating of the material 12, and also for exposing the greatest amount of fresh areas, regions, or surfaces of the material 12 to the lining 46, the height of the bricks 48, as measured from the surface 44 inward toward the longitudinal axis, should not be more than ten inches. In addition, the minimum depth of each trough of each wave formed by the inner face 47 of the lining 46 should be at least six inches, as measured from the surface 44 to the lowest point of the trough. In order to avoid putting undue stress and creating mechanical shearing forces on the peaks (protrusions 54) of the refractory bricks 48, the bricks 48 should not extend beyond ten inches from the surface 44. Also, the troughs of the bricks 48 forming the inner face 47 should be a minimum of six inches from the surface 44. This is due to the fact that if the troughs were, for example, four inches from the surface 44, then the bricks 48 would already be at that point at which they would need to be replaced to avoid further degradation and wearing away, which would result in the possible exposure of the surface 44. This is because of the tendency of any type of lining to get smoother over time. Therefore, by avoiding what in the industry is called the "tumbler effect", bricks 48 having a ten-inch thickness, as measured from the surface 44, to the tip of the protrusion 54 are safer from a thermal and mechanical standpoint and will have a longer life span than bricks having more than ten inch thickness. Moreover, for maximum efficiency of the inner face 47 of the lining 46, the sine wave should include at least ten cycles (or complete waves) propagated about the circumference of the surface 44 of the shell 20. In other words, the inner face 47 should include, at a minimum, ten peaks and ten troughs propagated annularly about the longitudinal axis and the surface 44.

In the preheating, calcining, and sintering zones of prior art kilns, approximately ninety percent of the heat transferred to the burden or material is by radiation and convection produced by the hot gases, and the remaining ten percent of the heat is transferred from the refractory lining to the material by conduction. Unfortunately, typical materials processed in kilns, such as cement, lime, dolomite, and magnesite, are heat insulators. As a consequence, the top layers of the material may be heated to the required processing temperature and, if not promptly removed from the surface by agitating or mixing, a portion of the heat absorbed by the top layers of the material will be reflected and returned to the gas stream moving through the open processing zone. In addition, there is a tendency for material traversing a kiln to form heterogeneous pockets, which leads to improperly cooked or fired material because not all of the material is being exposed to the hot kiln gases. There is also the tendency of certain types of material to segregate as the material flows through the kiln; and this is why a thorough, homogeneous mixing and uniform heating of the material is desired. The revolving action also accelerates solid-solid chemical reactions in the kiln 10, as well as a faster release of carbon dioxide from carbonaceous materials.

The kiln 10 uses a wave-shaped inner face 47 to continuously agitate and move the material 12 and to improve the heat efficiency or the heat transfer between the hot kiln gases and the material 12. Such an improved and more efficient utilization of the gas heat results in a lower gas exit temperature at the discharge end 24 and, consequently, reduces heat loss to the kiln stack (not shown). More specifically, by using the kiln 10 with the lining 46 and inner face 47, it has been discovered that a larger surface area of the material 12 can be more quickly exposed to the high temperature gases moving through the kiln 10, thereby improving heat transfer to the material 12 traversing the kiln 10.

Moreover, the lining 46 with the wave-shaped inner face 47 produces additional benefits, such as increasing the agitation and revolving of the material 12 within the kiln 10 and increasing the residence time of the material 12 within the kiln 10 in order to promote more efficient heat transfer. Utilizing the sinusoidal wave-shaped inner face 47, such as shown in FIGS. 2, 3, 5–7, and 9, produces superior heat transfer conditions within the shell 20 as opposed to those kilns which employ cylindrical lining designs. The superior heat transfer conditions generated by the kiln 10 can be made more explicit by examining the actual heat transfer mechanism that occurs within the kiln 10.

The heat required for pyro-processing materials in rotary kilns is supplied by high temperature gases produced, for example, by a combustion process. These gases include, but are not limited to, carbon dioxide, water vapor, carbon monoxide, sulfur dioxide, nitrogen, and oxygen. However, in order for a net transmission of heat energy from the hot gases to the material to occur, there must be a temperature gradient between the material and the hot gases so that heat can flow from the hot gases to the material. The amount of heat "Q" transferred by the gas in a time "t" is given by a general heat transfer equation: Q=a(Tg−Tm)FT. Where "a" is the heat transfer co-efficient; "Tg" is the gas temperature; "Tm" is the material temperature; and "F" is the surface area of the material. By carefully selecting the temperature gradient, it is possible to control the amount of heat "Q" transferred to the material. Under unfavorable conditions, the practice of the prior art was to increase the temperature gradient to improve heat transfer from the hot gases to the material. However, this resulted in a higher exit gas temperature, damage to the refractory lining, and higher heat loss through radiation.

Heat transfer within the kiln 10 is, in general, governed by the general heat transfer equation and comprises, but is not limited to, at least four different components, as illustrated in FIG. 2: (1) radiative heat transfer from the hot gases to the material; (2) convective heat transfer between the hot gases and the material; (3) radiative heat transfer between the refractory lining and the material; and (4) conductive heat transfer from the refractory lining to the material. It has been discovered that the kiln 10 using the lining 46 with the inner face 47 improves all of the above four heat transfer modes. Specifically, the wave-shaped inner face 47 decreases the residence time of individual burden particles on the surface of the material 12 after such particles absorb heat from the hot gases. This improves the heat transfer because less heat is re-transferred from the material 12 to the gases exiting the kiln 10. Additionally, the inner face 47 increases the overall residence time of the material 12 in the kiln 10 and also increases the amount of surface area of the material 12 which is exposed to the hot gases and to the lining 46 of the kiln 10.

Figure 5:
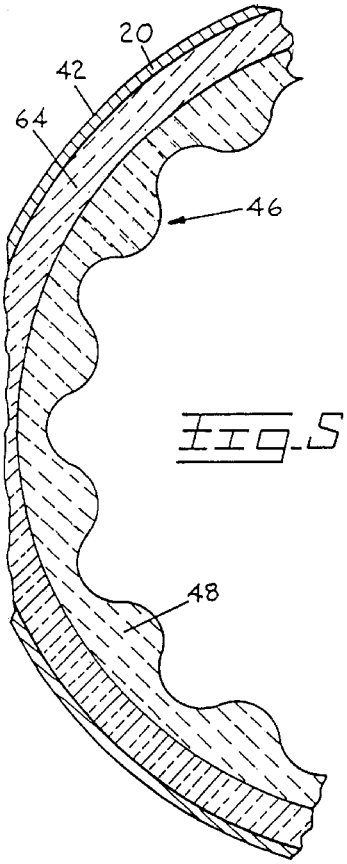
FIG. 5 is a cross sectional view of a kiln having a lining secured to a layer of insulating material.
Figure 6:
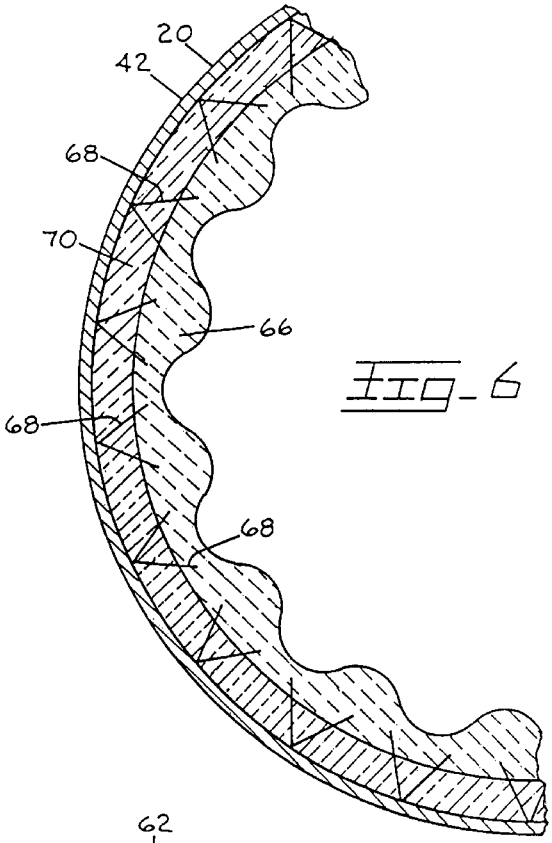
FIG. 6 is a cross sectional view of a kiln having a lining and inner face formed from a castable refractory material.
Figure 3:
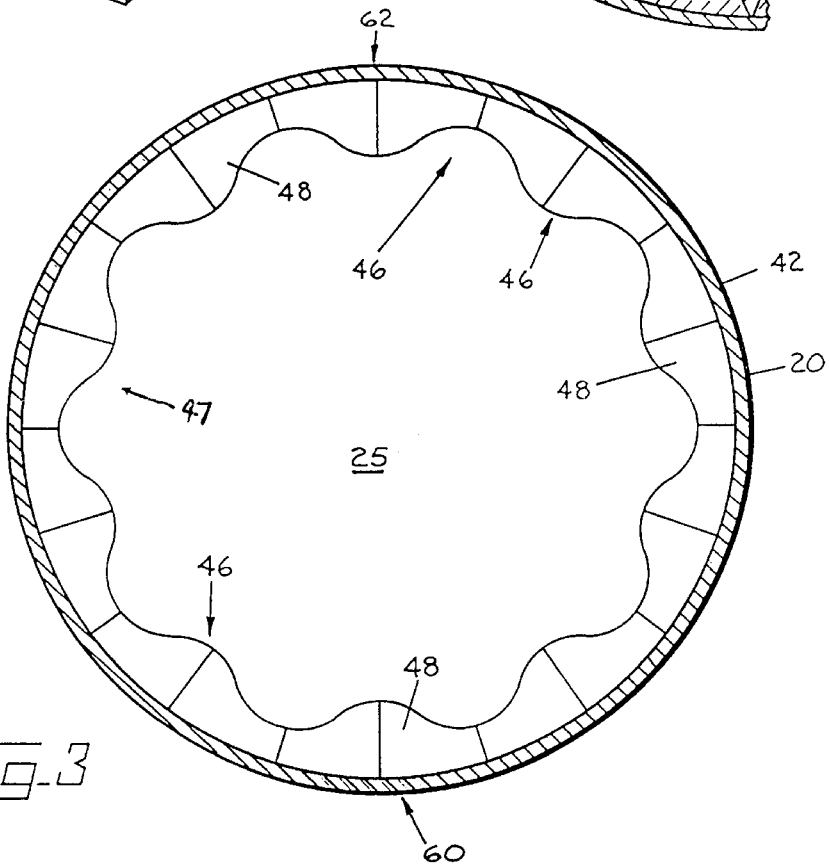
FIG. 3 is a cross sectional view of the kiln first shown in FIG. 1 illustrating a lining with an inner face differing in amplitude and wavelength from the inner face of FIG. 2.

As shown in FIG. 5, in higher temperature applications, the refractory bricks 48, which are shaped and arranged to form the wave shape of the inner face 47, may be contiguously secured to a layer of insulating material 64 which serves to reduce the heat flow toward the shell 20. FIG. 6 illustrates an alternative embodiment for forming the wave shape of the inner face 47 and discloses a lining 66 which may be formed from a castable refractory material that hardens like concrete upon being mixed with water. The lining 66 is installed by gunning or pouring behind forms installed on the surface 44.

Figure 7:
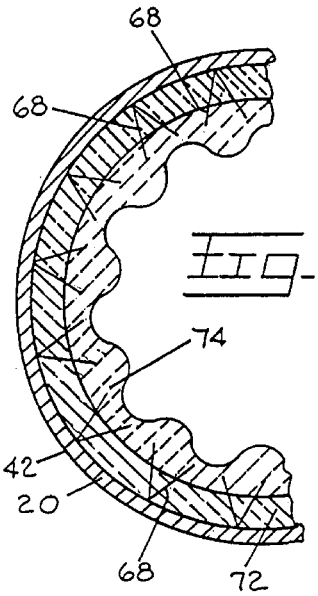
FIG. 7 is a cross sectional view of a kiln having a lining and inner face formed from two types of refractory material.

When castable refractory material is used to form linings 64 and 66, the castable refractory material is secured to the surface 44 by metal anchors 68, shown in FIGS. 6 and 7, which are welded to the surface 44 prior to installation of the refractory material. For high temperature applications, ceramic anchors are used in place of metal anchors 68. The ceramic anchors are held in place by metal C-clips (not shown) welded to the surface 44. These anchors, whether metal or ceramic, are attached to the shell 20 in a predetermined pattern and have a height of about one-half to three-fourths of the total thickness of the refractory material that is to be applied. The wide variety and selection of such anchors, as well as the appropriate material, shape, and design for any particular installation, are well known in the art.

For high temperature applications, the material 66 may be cast upon a ceramic fiber blanket 70, which is placed between and around the anchors 68 to insulate the shell 20 as shown in FIG. 6. A similar result can be obtained, instead, by using two types of refractory materials, as shown in FIG. 7. An initial refractory layer 72 of a lightweight, castable material is applied onto the surface 44. After curing, the layer 72 is coated with a higher temperature, higher abrasion resistant, higher refractory material 74. This type of combination of different materials is well known in the art for use, for example, in the processing of molten metals. Finally, the lining 46 for a wave-shaped inner face may be cast in place with the assistance of steel forms. The forms may be made of steel or wood and would be secured against the surface 44 by tack welding or bolting. Once the form is secured in place, the form cavity reflecting the sinusoidal wave shape is filled with refractory castable material. Furthermore, combinations of precast shapes, shaped bricks, and mortar may be used to achieve the desired sinusoidal wave-shaped configuration for the inner face of the lining.

The foregoing is considered as illustrative only of the principles of the invention. Further, since numerous modifications and changes will readily occur to those skilled in the art, it is not desired to limit the invention to the exact construction and operation shown and described. Accordingly, all suitable modification and equivalents may be resorted to that fall within the scope of the invention.

I claim:

1. A kiln for processing material with high temperature gases, comprising:

a cylindrical, elongated shell having a feed end, an opposite discharge end, and defining a longitudinal axis extending therethrough;

the shell having an inner cylindrical surface circumjacent the longitudinal axis;

means to rotate the shell in order to facilitate homogeneous mixing and heating of the material;

a lining disposed within the shell and secured contiguous to the inner cylindrical surface, the lining having an inner face in the shape of a continuous sinusoidal wave of predetermined amplitude and wavelength so that the peaks and troughs of each respective wave are of equal height and depth whereupon the material contacts the wave-shaped inner face for thorough, homogeneous heating and mixing of the material as the material moves from the feed end to the discharge end.

2. A kiln for processing material with high temperature gases, comprising:

a cylindrical, elongated shell having a feed end, an opposite discharge end, and defining a longitudinal axis extending therethrough;

the shell having an inner cylindrical surface circumjacent the longitudinal axis;

means to rotate the shell in order to facilitate homogeneous mixing and heating of the material;

a lining cast directly onto the inner cylindrical surface as a unitary structure;

the lining having an inner face in the shape of a continuous sinusoidal wave with the peaks and troughs of each respective wave equal in height and depth so that the material contacts the wave-shaped inner face for thorough, homogeneous heating and mixing of the material as the material moves from the feed end to the discharge end.

3. The kiln of claim 2 wherein the inner face has the shape of a sinusoidal wave with a determinate amplitude and wavelength.

4. The kiln of claim 3 wherein the distance from the inner cylindrical surface to the peak of each respective wave should not be greater than ten inches.

5. The kiln of claim 4 wherein the distance from the inner cylindrical surface to the trough of each respective wave should be at least six inches.

6. The kiln of claim 5 wherein the wave-shaped inner face increases the amount of surface area of the inner face which contacts the material as the material travels through the shell.

7. The kiln of claim 6 wherein the wave-shaped inner face should include at least ten peaks and ten troughs circumjacent the longitudinal axis of the shell.

8. The kiln of claim 7 wherein the lining includes a plurality of bricks which form the inner face and are secured to the inner cylindrical surface with each brick having a base portion for securement contiguous to the inner cylindrical surface, an opposite protrusion which extends inwardly toward the longitudinal axis, and an S-shaped slope which runs from the protrusion to the base portion.

9. The kiln of claim 8 wherein the bricks are annularly arranged in succession along the inner cylindrical surface of the shell in order to form the continuous wave shape.

10. The kiln of claim 9 wherein the bricks are composed of a refractory material.

11. The kiln of claim 10 wherein the bricks are composed of a ceramic material.

12. The kiln of claim 2 wherein the wave-shaped inner face should include at least ten peaks and ten troughs circumjacent the open processing zone.

13. The kiln of claim 2 wherein the lining with the wave-shaped inner face is formed directly onto the inner cylindrical surface as a unitary structure.

* * * * *